US011612795B1

(12) United States Patent
Hutson

(10) Patent No.: US 11,612,795 B1
(45) Date of Patent: Mar. 28, 2023

(54) GAME ASSEMBLY

(71) Applicant: Chad Edward Hutson, Midwest City, OK (US)

(72) Inventor: Chad Edward Hutson, Midwest City, OK (US)

( * ) Notice: Subject to any disclaimer, the term of this patent is extended or adjusted under 35 U.S.C. 154(b) by 0 days.

(21) Appl. No.: 17/230,180

(22) Filed: Apr. 14, 2021

Related U.S. Application Data

(60) Provisional application No. 63/031,928, filed on May 29, 2020.

(51) Int. Cl.

| | |
|---|---|
| ***A63B 67/06*** | (2006.01) |
| ***A63B 43/00*** | (2006.01) |
| ***A63B 47/02*** | (2006.01) |
| ***A63B 63/06*** | (2006.01) |
| ***A63F 9/02*** | (2006.01) |

(52) U.S. Cl.
CPC ..... *A63B 67/06* (2013.01); *A63B 43/005* (2013.01); *A63B 47/02* (2013.01); *A63B 63/06* (2013.01); *A63F 9/0208* (2013.01)

(58) Field of Classification Search
CPC ... A63B 47/02; A63B 63/06–2063/065; A63B 67/06; A63F 9/0204–0243; A63F 2009/0213–0239; F41J 3/0004; F41J 7/04
See application file for complete search history.

(56) References Cited

U.S. PATENT DOCUMENTS 675,804 A * 6/1901 Tyrell ..... F41J 7/04 273/392
687,873 A * 12/1901 Daniels ..... F41J 7/04 273/390
1,705,501 A * 3/1929 Sas ..... A63F 9/0243 273/339
2,580,799 A * 1/1952 Lauterbach ..... A63B 63/06 473/476
4,961,587 A * 10/1990 Galvin ..... A63B 63/06 273/386
5,472,211 A * 12/1995 McCaughan ..... A63B 67/06 273/401
7,004,468 B2 * 2/2006 Johnson ..... A63B 67/06 273/343
D525,312 S * 7/2006 Rinehart ..... D21/302
8,109,518 B2 * 2/2012 Blagg ..... A63F 9/0243 473/514
8,444,150 B1 * 5/2013 Stirtz ..... A63B 67/06 273/369
10,596,450 B2 * 3/2020 Lattin ..... A63F 9/0208

FOREIGN PATENT DOCUMENTS

DE 20009077 U1 * 8/2000 ..... A63F 9/0243

* cited by examiner

*Primary Examiner* — Laura Davison

(74) *Attorney, Agent, or Firm* — Plager Schack LLP; Mark H. Plager; Michael J. O'Brien

(57) ABSTRACT

A game assembly is configured to be used in a target throwing game. The game assembly has a target further comprising a three-dimensional polygon having twenty-six sides. A game surface is attached to at least one side on the three-dimensional polygon. A mounting bracket is attached to the target and to vertical surface joined to a ground surface. At least one ball has an attachment surface configured to detachably join to the game surface. Throwing the at least one ball at the game surface can score points for a user of the game assembly.

3 Claims, 4 Drawing Sheets

GAME ASSEMBLY

RELATED APPLICATION

This application claims priority to provisional patent application U.S. Ser. No. 63/031,928 filed on May 29, 2020, the entire contents of which is herein incorporated by reference.

BACKGROUND

The embodiments herein relate generally to entertainment devices.

Prior to embodiments of the disclosed invention game devices required unique features for improved play. Embodiments of the disclosed invention solve this problem.

SUMMARY

A game assembly is configured to be used in a target throwing game. The game assembly has a target further comprising a three-dimensional polygon having twenty-six sides. A game surface is attached to at least one side on the three-dimensional polygon. A mounting bracket is attached to the target and to vertical surface joined to a ground surface. At least one ball has an attachment surface configured to detachably join to the game surface. Throwing the at least one ball at the game surface can score points for a user of the game assembly.

In some embodiments, a ball pick up stick is arranged proximate to the target that has a material covering configured to pick up the at least one ball. A threaded rod can arranged through the target and attached to the mounting bracket. A plurality of bearings and nuts, joined to the threaded rod such that the game surface rotates around a central axis defined by the threaded rod. The at least one ball further comprises at least one lighter weight ball and at least one heavier weight ball. The target further comprises at least two bearing openings configured to accommodate the plurality of bearings.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
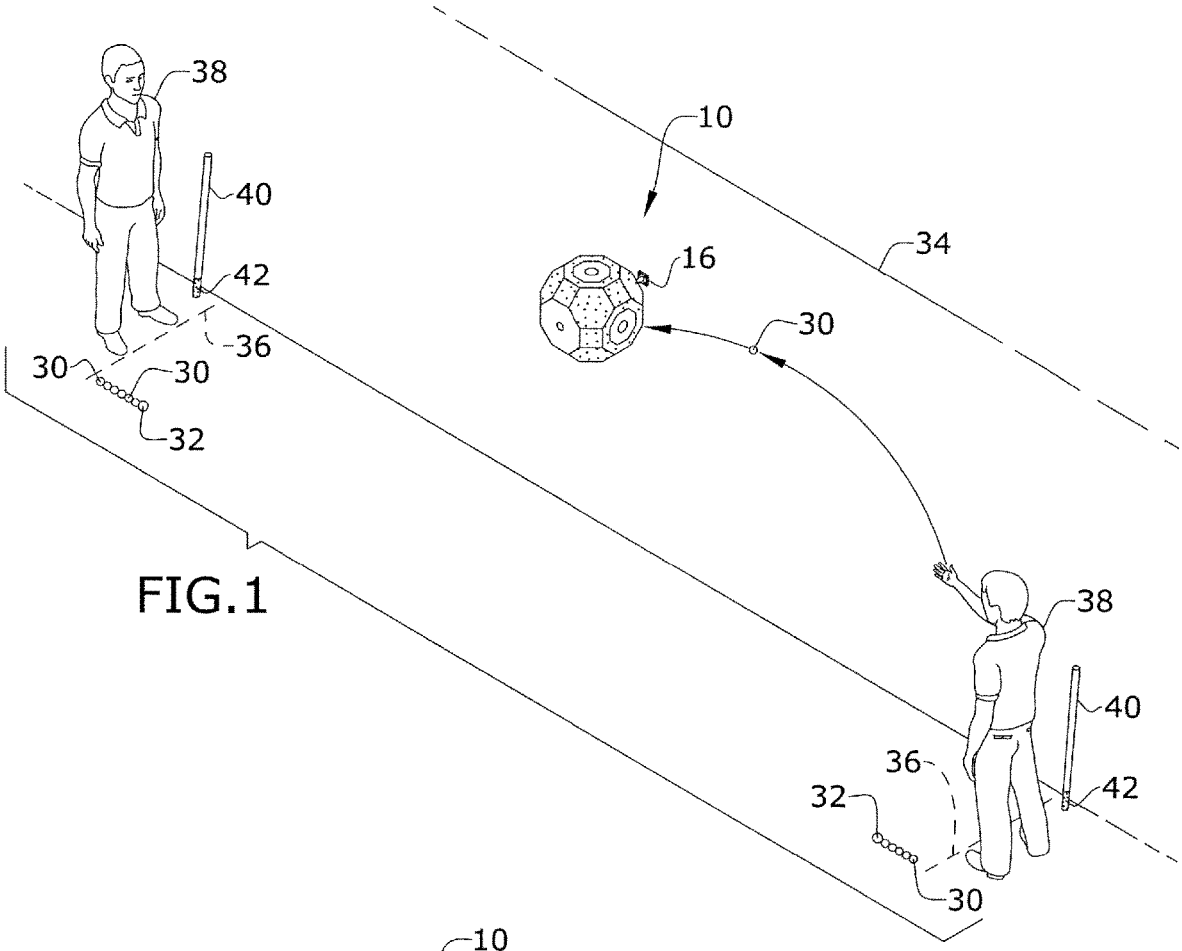
FIG. 1 shows a perspective view of one embodiment of the present invention shown in use.
Figure 2:
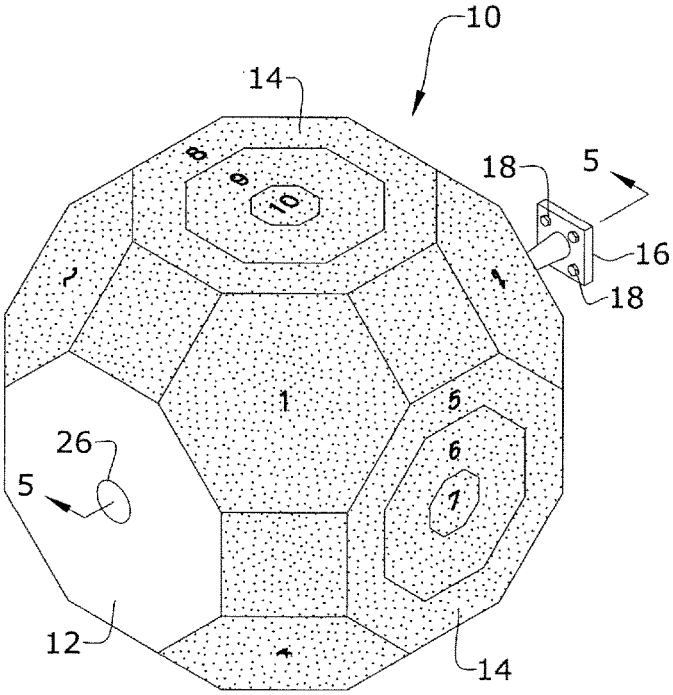
FIG. 2 shows a perspective view of one embodiment of the present invention.
Figure 3:
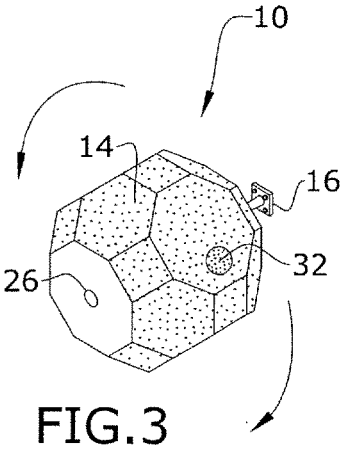
FIG. 3 shows a perspective view of one embodiment of the present invention.
Figure 4:
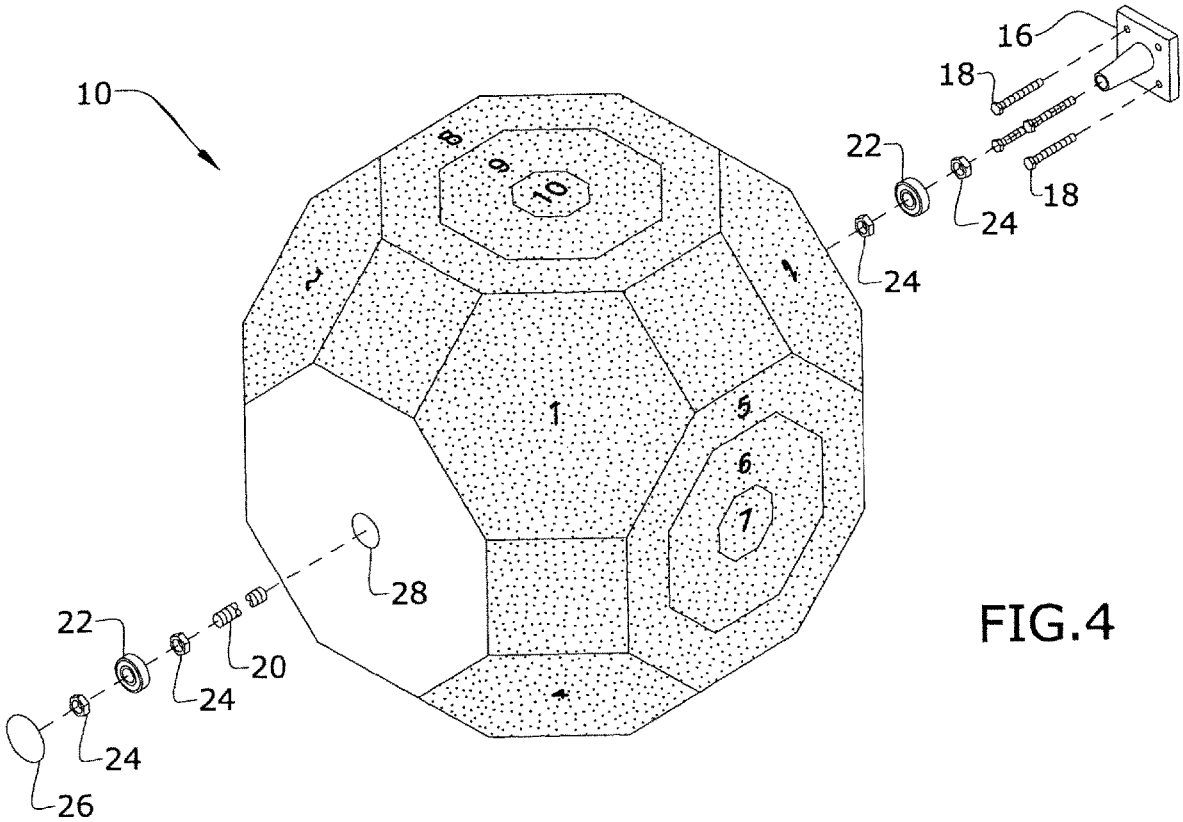
FIG. 4 shows an exploded view of one embodiment of the present invention.
Figure 5:
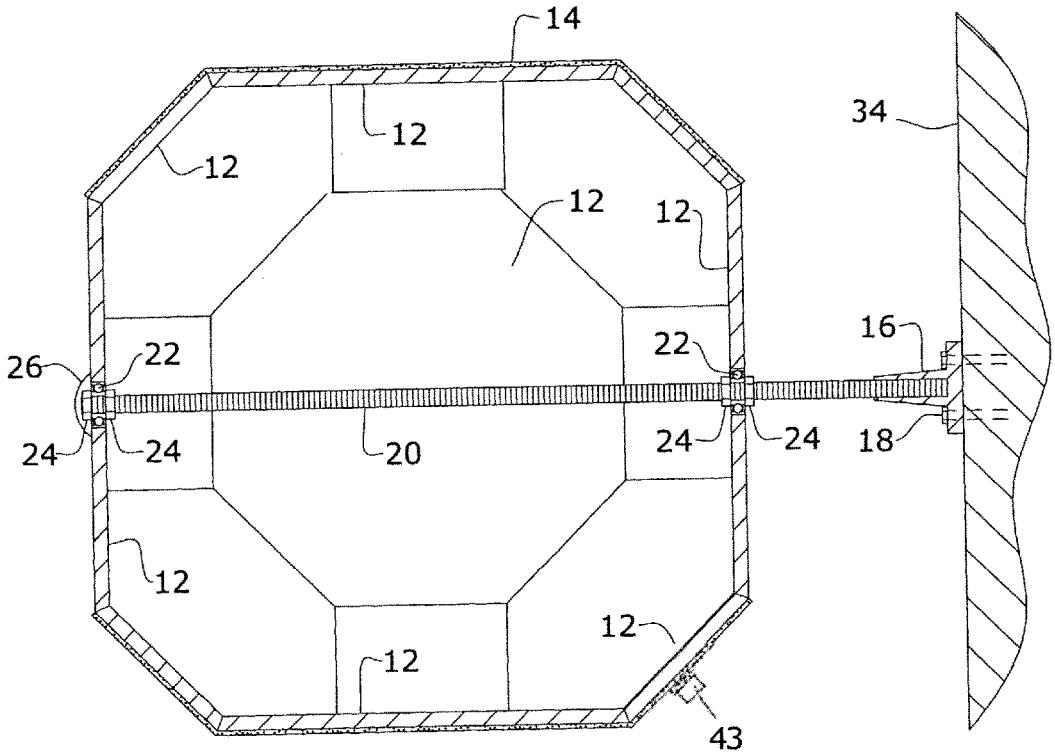
FIG. 5 shows a section view of one embodiment of the present invention taken along line 5-5 in FIG. 2.
Figure 6:
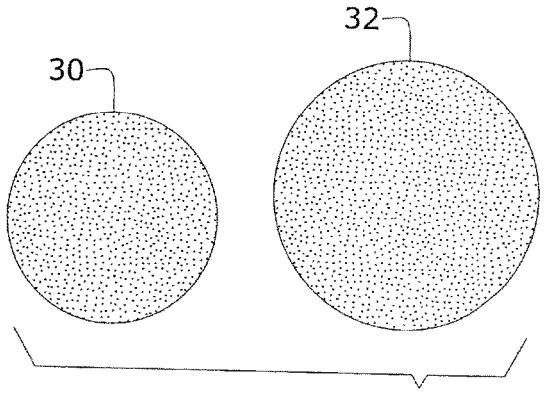
FIG. 6 shows a detail view of one embodiment of the present invention.
Figure 7:
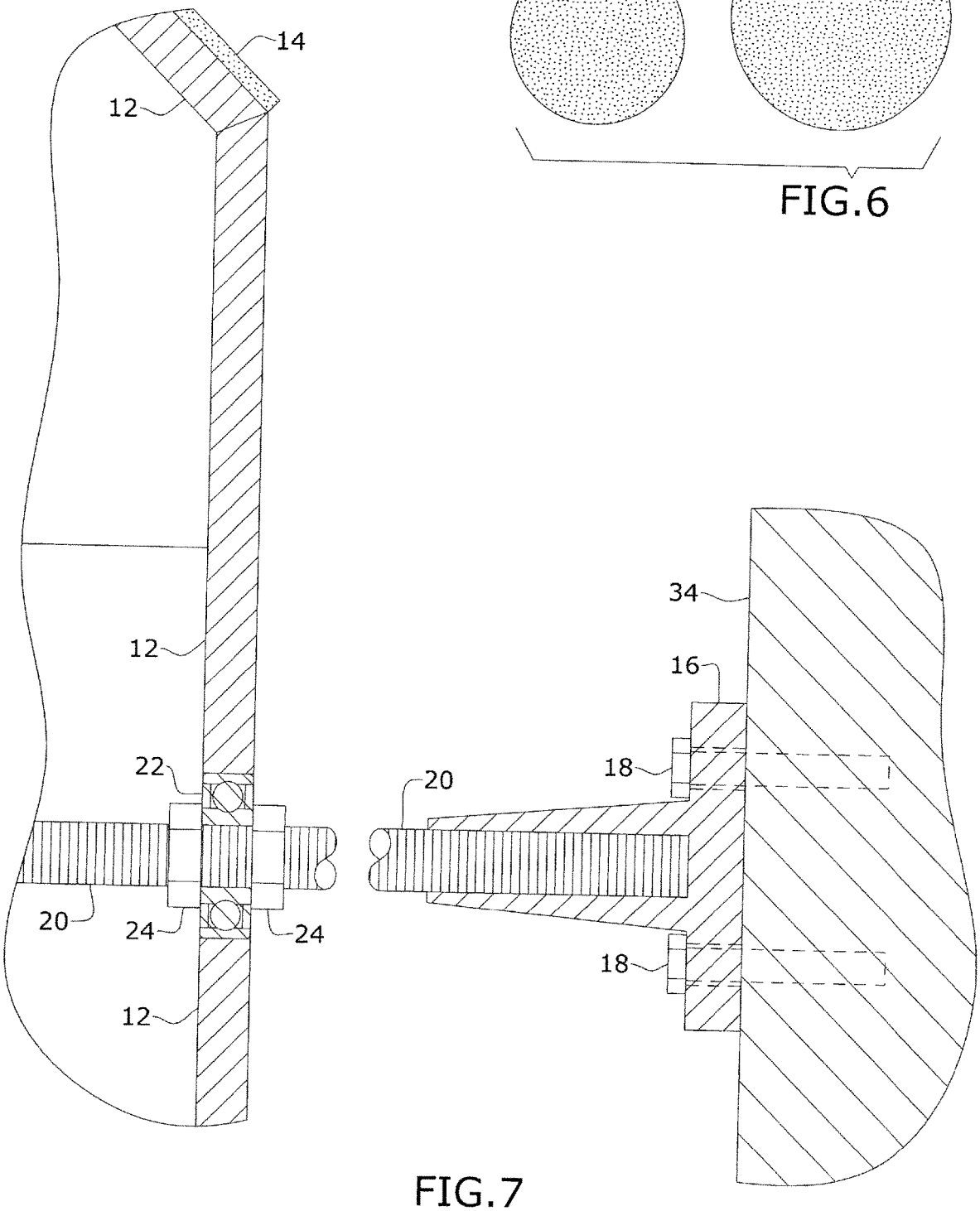
FIG. 7 shows an enlarged section view of one embodiment of the present invention.
Figure 8:
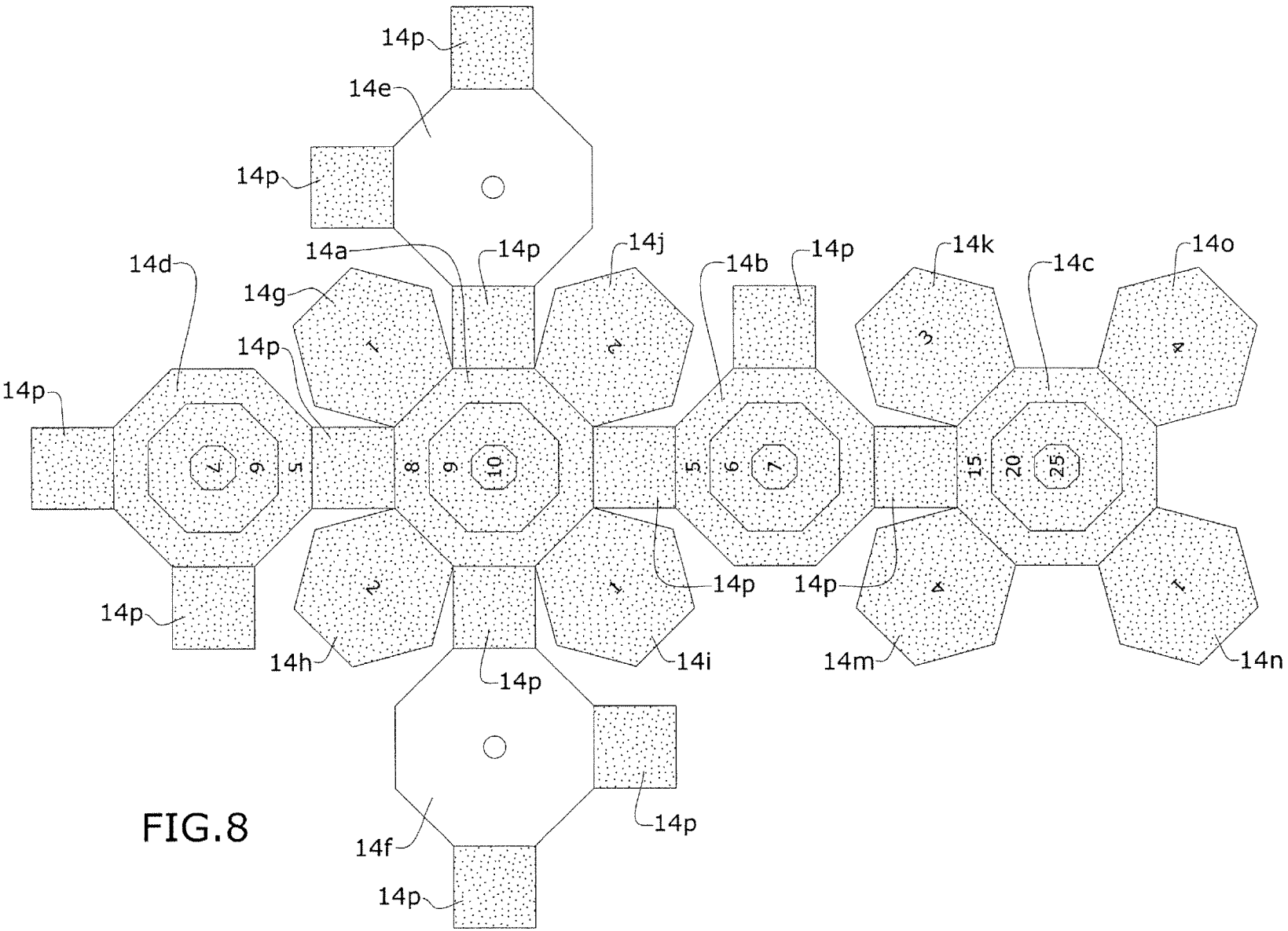
FIG. 8 shows a flatten illustration of one embodiment of the game surface of the present invention.

By way of example, and referring to FIGS. 1-8, one embodiment of game assembly 10 is configured to be used in a target throwing game. The game assembly 10 has a target 12 further comprising a three-dimensional polyhedron having twenty-six polygon sides 14*a*-14*k* and 14*m*-14*p*. A game surface 14 is attached to at least one side on the three-dimensional polygon. A mounting bracket 16 is attached to the target and to vertical surface 34 with mounting screws 18. The vertical surface 34 is joined to a ground surface. At least one ball 30 has an attachment surface configured to detachably join to the game surface 14. Throwing at least one ball 30 at the game surface 14 can score points for a user 38 of the game assembly 10.

In some embodiments, a ball pick up stick 40 is arranged proximate to the target that has a material covering 42 configured to pick up the at least one ball 30. A threaded rod 20 can be arranged through the target 12 and attached to the mounting bracket 16. A plurality of bearings 22 and nuts 24, joined to the threaded rod 20 such that the game surface 14 rotates around a central axis defined by the threaded rod 20 secured to a cap 26. The at least one ball 30 further comprises at least one lighter weight ball 30 and at least one heavier weight ball 32. The target 12 further comprises at least two bearing openings 28 configured to accommodate the plurality of bearings 22.

In some embodiments, throwing lines 36 can be arranged on the ground surface approximately eight feet from the target 12. A weight 43, can be used on one of the surfaces in order to stabilize the target 12.

As used in this application, the term "a" or "an" means "at least one" or "one or more."

As used in this application, the term "about" or "approximately" refers to a range of values within plus or minus 10% of the specified number.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 116. In particular, any use of "step of" in the claims is not intended to invoke the provision of 35 U.S.C. § 112, 116.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A game assembly, configured to be used in a target throwing game, the game assembly comprising:

a target further comprising a three-dimensional polyhedron having twenty-six sides;

a game surface, attached to at least one side on the three-dimensional polyhedron;

a mounting bracket, attached to the target and to a vertical surface joined to a ground surface;

at least one ball, further comprising an attachment surface configured to detachably join to the game surface;

a ball pick up stick, arranged proximate to the target that has a material covering configured to pick up the at least one ball;

a threaded rod, arranged through the target and attached to the mounting bracket;

a plurality of bearings and nuts, joined to the threaded rod such that the game surface rotates around a central axis defined by the threaded rod;

wherein throwing the at least one ball at the game surface can score points for a user of the game assembly.

2. The game assembly of claim 1, wherein the at least one ball further comprises at least one lighter weight ball and at least one heavier weight ball.

3. The game assembly of claim 2, wherein the target further comprises at least two bearing openings configured to accommodate the plurality of bearings.

* * * * *